United States Patent [19]

Bertram et al.

[11] Patent Number: 4,993,595

[45] Date of Patent: Feb. 19, 1991

[54] CONTAINER FOR MULTICOMPONENT PRODUCTS

[75] Inventors: Horst Bertram; Bernhard Bongers, both of Duesseldorf; Herbert Buecheler, Erkrath; Peter Kittscher, Kaarst, all of Fed. Rep. of Germany

[73] Assignee: Henkel Kommanditgesellschaft auf Aktien, Duesseldorf-Holthausen, Fed. Rep. of Germany

[21] Appl. No.: 353,566

[22] Filed: May 18, 1989

[51] Int. Cl.[5] ..... B65D 1/04

[52] U.S. Cl. ..... 222/129; 222/145; 222/479; 222/571

[58] Field of Search ..... 222/129, 145, 478, 479, 222/566, 571, 106, 109; 220/20; 215/6

[56] References Cited

U.S. PATENT DOCUMENTS

| | | | |
|---|---|---|---|
| 3,458,076 | 7/1969 | Babcock | 222/129 |
| 3,472,423 | 10/1969 | Kaplan | 222/129 |
| 3,729,553 | 4/1973 | Gold et al. | 424/44 |
| 4,585,150 | 4/1986 | Beacham et al. | 222/129 |
| 4,666,065 | 5/1987 | Ohren | 222/571 |
| 4,678,103 | 7/1987 | Dirksing | 222/130 |

FOREIGN PATENT DOCUMENTS

| | | | |
|---|---|---|---|
| 310933 | 4/1989 | European Pat. Off. | 222/129 |
| 461572 | 2/1927 | Fed. Rep. of Germany | 222/129 |

*Primary Examiner*—Joseph E. Valenza
*Assistant Examiner*—Steven M. Reiss
*Attorney, Agent, or Firm*—Ernest G. Szoke; Wayne C. Jaeschke; Kenneth Watov

[57] ABSTRACT

A multicomponent product container includes two separate component compartments covered by a common pouring cap, individual pouring openings for the first and second components contained in the compartments, respectively, offset from one another relative to the longitudinal axis of the container and opening in the plane of an outer surface provided in said cap. The pouring openings are each juxtaposed in the pouring direction necessary to dispense the first and second components, by an individual pouring edge, which both rises beyond the outer surface of the cap, and projects beyond the associated pouring opening in the lateral or peripheral direction. Each pouring edge is shaped for providing in the tilted position of the container necessary for pouring via gravity said first and second components from said pouring openings, a sink formed in the region of the associated pouring opening.

9 Claims, 5 Drawing Sheets

CONTAINER FOR MULTICOMPONENT PRODUCTS

BACKGROUND 1.0 Field of the Invention

This invention relates generally to containers, and more particularly to containers for storing and dispensing multicomponent products.

2.0 Discussion of Related Art

There are various known types of multicomponent product containers comprising two or more component compartments for components which are only to be mixed for use. Such containers are used, for example, for accommodating shampoos, detergents, adhesives and the like. U.S. Pat. No. 3,729,553 describes a container for multicomponent products in which the pouring openings for the compartments are arranged laterally adjacent one another in the pouring direction. Two guide webs are formed between the pouring openings, allegedly to prevent the components from flowing into one another during pouring. Two pouring streams are formed.

In another known two-component container (see U.S. Pat. No. 4,585,150), the pouring openings are formed in a cap covering both component compartments. The pouring openings are arranged radially offset from one another in this circular cap. They open into the outer surface of the cap which is otherwise plane. This known multicomponent container is deficient with regard to its pouring properties. In addition, residual liquid of one or the other component can flow over into the particular openings when the multicomponent container is returned from the pouring position to a rest or storage position.

3.0 Summary of the Invention

In view of the prior art as described in the foregoing, one object of the present invention is to provide an improved multicomponent container of simple construction.

In the multicomponent container according to one embodiment of the invention, the pouring edges which surround the respective pouring openings form a weir for the streams of components issuing from the pouring openings, which streams are ultimately combined into a substantially single pouring stream. During tilting of the container, and subsequent pouring of the components, they flow through a stabilizing zone in annular troughs formed by the pouring edges, thereby providing a very stable, easy-to-handle pouring stream. The pouring stream from the inner pouring opening is "laid" on the pouring stream of the outer pouring opening.

In a preferred embodiment, the pouring edges are in the form of encircling edges. An encircling annular groove is thus formed between the inner and outer pouring edges. When the multicomponent container is turned back from the pouring position into an upright position, liquid is unable to pass from the outer pouring opening to the inner pouring opening. Any residues remaining outside the cap surface are collected in the annular groove. Similarly, only a very small quantity, if any, of the component liquid is able to enter the annular groove from the inner pouring opening. The pouring edges which also surround the inner pouring opening provide for very clean breakaway properties of the pouring stream issuing from the inner pouring opening.

The cap is preferably rotationally symmetrical except for the pouring openings and the web to be explained hereinafter. The pouring edges are thus concentrically circular to one another in shape.

In another preferred embodiment, the height of the inner pouring edge is slightly less than that of the outer pouring edge. This has proved to be beneficial in regard to the pouring characteristic. The distance between the pouring edges may substantially correspond to the height of the inner pouring edge. The outer edges of the pouring openings may extend approximately to the foot of the pouring edges or may be directly formed by the pouring edges. The width of the outer pouring opening in the radial direction is preferably slightly smaller than the distance between the pouring edges, so that the inner edge of the outer pouring opening is not directly formed by the inner pouring edge.

In yet another dimensionally preferred embodiment, the height of the inner pouring edge substantially corresponds to the opening width in the radial direction of the associated pouring opening, and the opening widths of the two pouring openings in the radial direction are substantially equal. Different dosing of one and the other component is obtained through the different peripheral extent of the pouring openings. The larger pouring opening is preferably the outer pouring opening.

In still another preferred embodiment, the pouring openings or rather their outer and inner edges are arcuate in shape.

In another embodiment, the invention relates to a multicomponent container which embodies one or more of the features described above, and particularly in which the pouring openings differ in size from one another. In a multicomponent container such as this, in which the cap is otherwise, i.e. except for the pouring openings, rotationally symmetrical, another two pouring openings are formed diametrically opposite the first pouring openings. In addition, the pouring openings are formed in mirror symmetry to one another so that each pair of pouring openings can be arranged proximate the front in the pouring direction, i.e. can perform the pouring function. The diametrically opposite, rear pouring openings are used for venting.

Since the two pairs of pouring openings are identical with one another, the cap may also be applied offset through 180° at the assembly stage. This is made possible via use of a guide tab formed on the common central axis of all the pouring openings substantially in the middle of the cap. The guide tab may be gripped, for example, by an assembly robot. There is no need for the caps to be sorted as to "front" or "rear" for delivery to the assembly robot.

BRIEF DESCRIPTION OF THE DRAWINGS

Various embodiments of the invention are described in detail below with reference to the accompanying drawings, in which like items are identified by the save reference number, wherein.

DETAILED DESCRIPTION OF THE INVENTION

Figure 1:
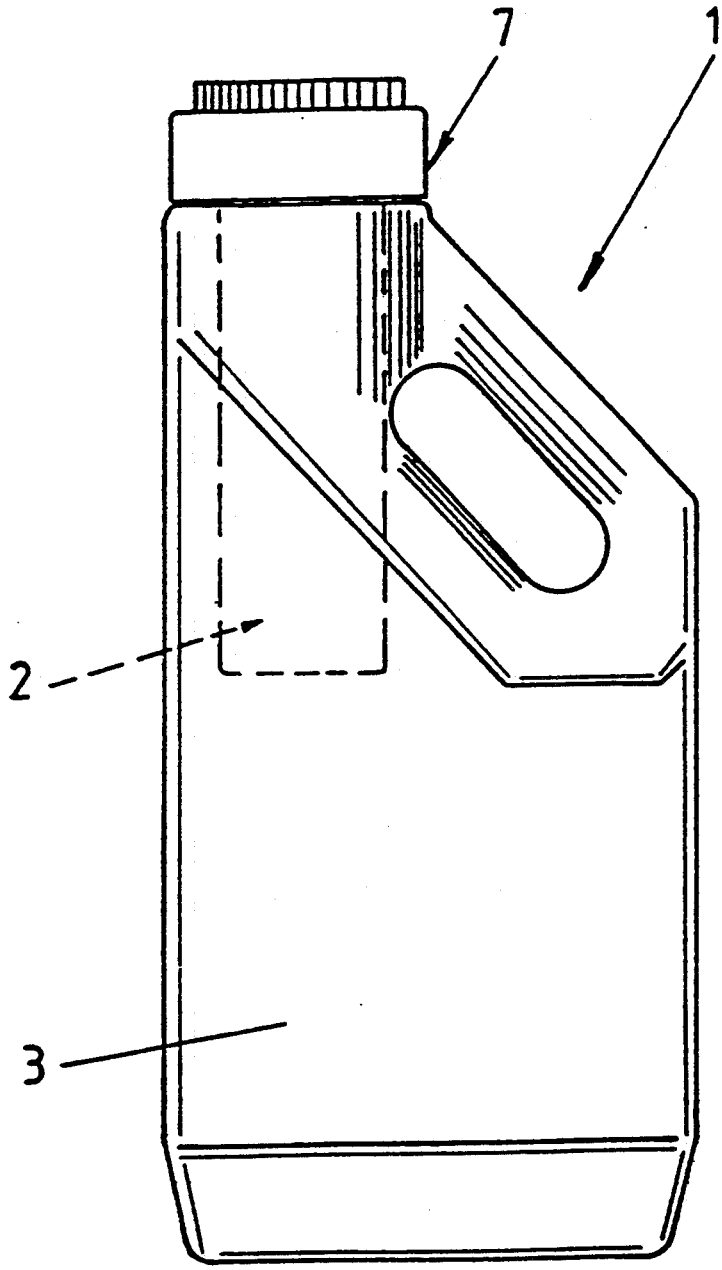
FIG. 1 is a side elevation view of a multicomponent bottle or outer container of one embodiment of the invention.

The multicomponent container or bottle 1 as illustrated in FIG. 1, for example, comprises two component compartments 2 and 3 accommodating different liquid components, which are only to be mixed just before use of the resultant multicomponent product. The liquids are poured out by gravity, and mixed while being poured, as will be described below.

The inner component compartment 2 is accommodated in the bottle neck 4 (see FIGS. 2 and 3) by means of a pouring cap 5. The pouring cap 5 is designed to be clipped onto the rim 6 of the bottle 1. The component compartment 2 is designed to be screwed by means of its external screw thread 23 into the neck 25 (provided with an internal screw thread 24) of the pouring cap 5. To close the multicomponent bottle 1, the pouring cap 5 may be covered by the closure cap 7 (see FIG. 1), which is designed to be screwed, via internal threads 7'; onto external threads 8' of the neck 8 of the bottle 4. In the closed position, the sealing flanges 9 and 10 tightly seal against the inside of the pouring edges 11 and 12.

Figure 4:
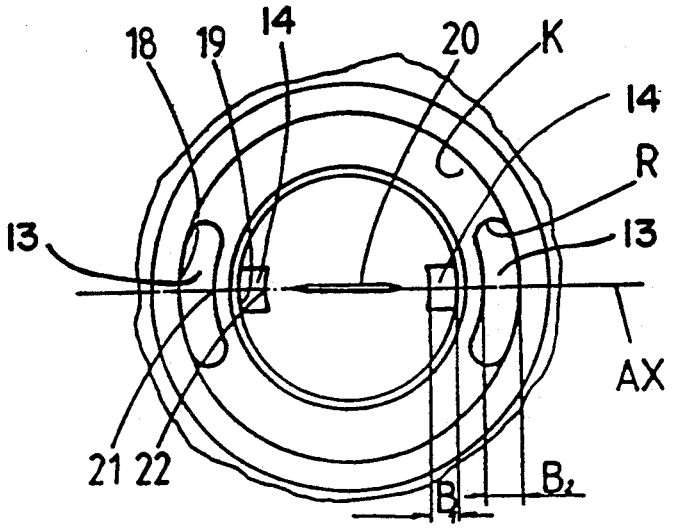
FIG. 4 is a corresponding partial top plan view thereof.
Figure 5:
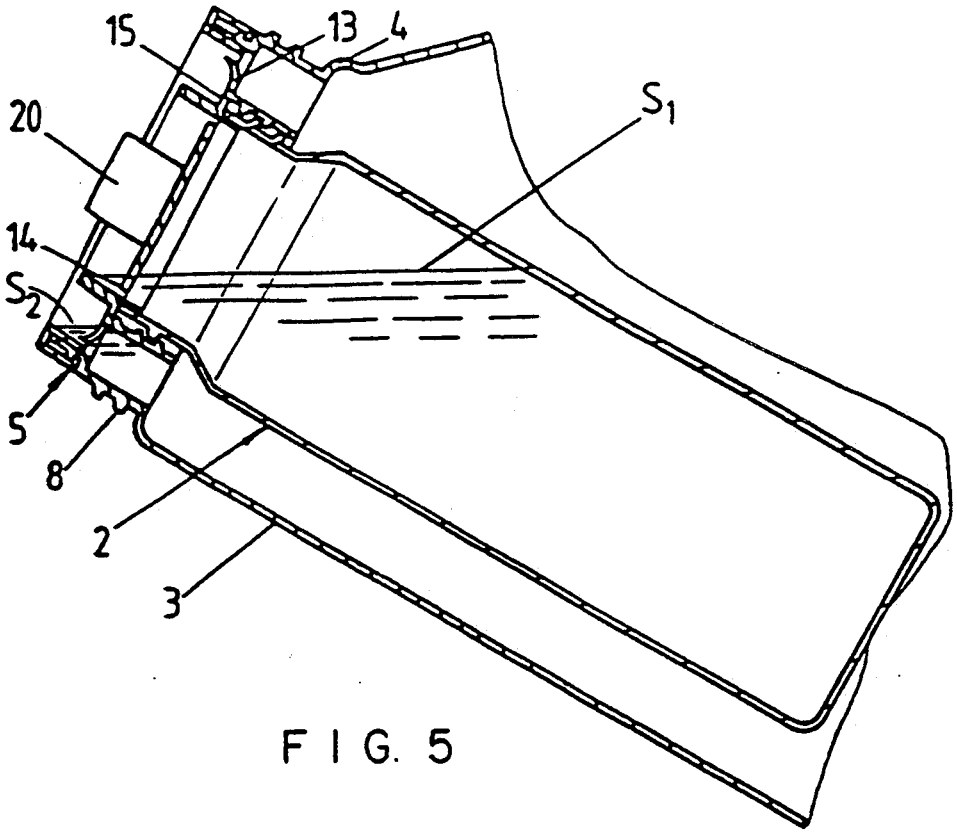
FIG. 5 shows the bottle neck according to FIG. 3 in the tilted position before the components are poured out.
Figure 6:
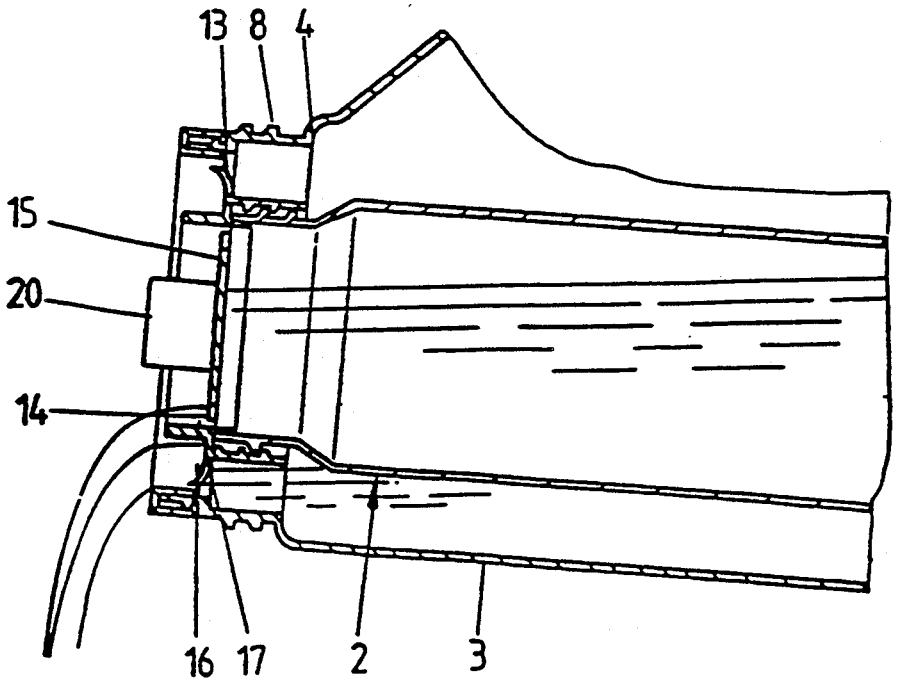
FIG. 6 shows the bottle neck according to FIG. 3 in the tilted position during pouring.
Figure 7:
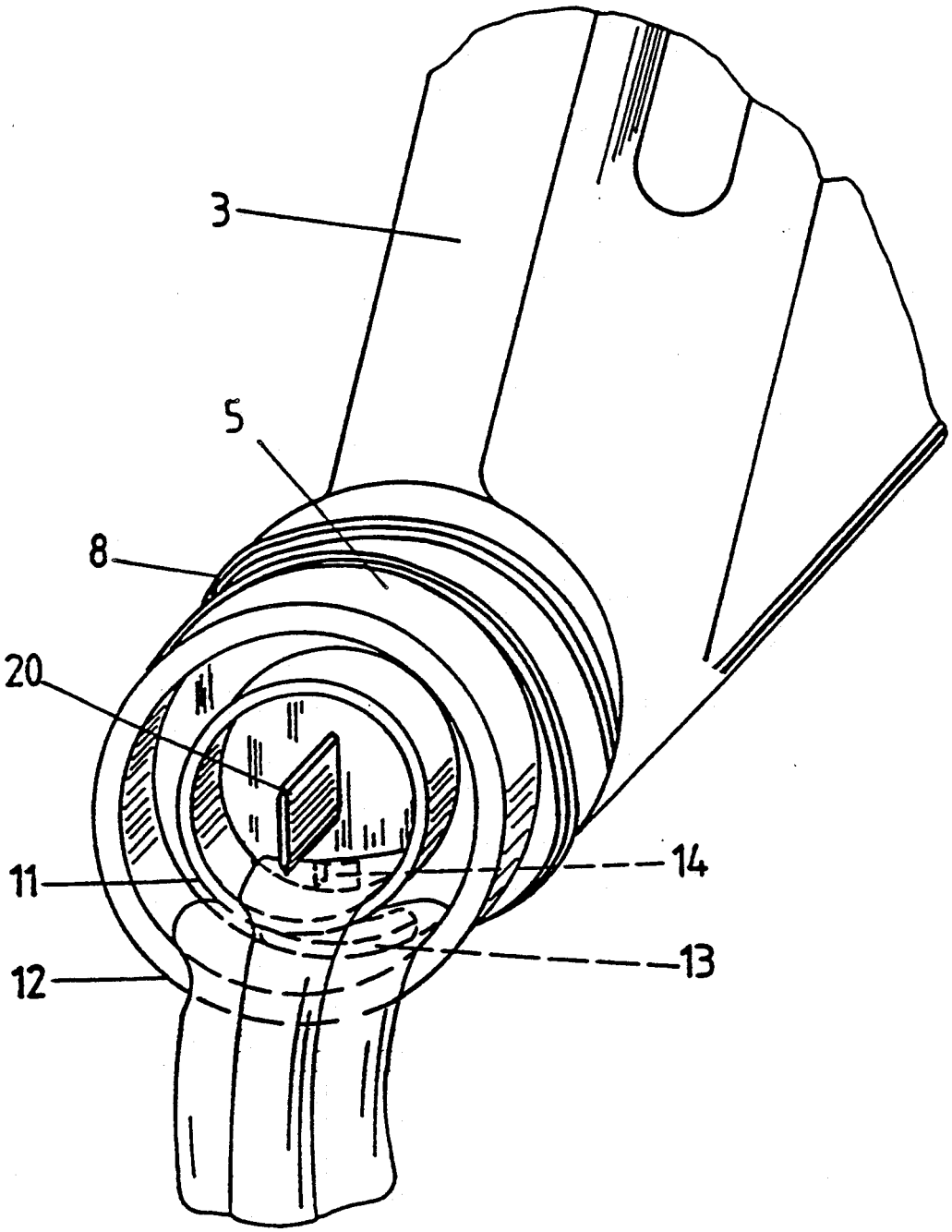
FIG. 7 is a perspective view of the head of the bottle during pouring.

Pouring openings 13 and 14 for the first and second components are formed in the pouring cap 5. Both pouring openings 13 and 14 are juxtaposed in the pouring direction to pouring edges 11 and 12 which rise beyond the plane of the outer surface 15 of the cap 5. In the lateral or peripheral direction, as shown in FIG. 4 for example, the pouring edges 11 and 12 form arcs that are centered with but are longer than or project beyond the ends of the maximum arcs formed by the pouring openings 13 and 14 respectively. In the tilted position, as shown in FIGS. 6 and 7, for example, sinks 16 and 17 are formed substantially centrally of the respective pouring openings 13 and 14. During pouring, the pouring edges 11 and 12 form a weir for the stream of liquid. This produces the pouring characteristic shown in FIG. 7, whereby a weir-like stage, for example, is formed before the pouring opening 13 and 14 with a width which exceeds the width of the associated pouring opening. As shown in FIG. 5, just before a pouring stream is formed, the correspondingly outwardly spreading liquid levels S1 and S2 are established in the component compartments 2 and 3.

The stream of liquid issuing from the inner pouring opening 14 is in effect "laid" on the outer, larger liquid stream issuing from the pouring opening 13. Where the liquid streams differ from one another in color, streaks are formed (always surface-oriented streaks on a relatively wide base stream). Favorable pouring properties are also obtained where the liquids in the component compartments 2 and 3 differ from one another in viscosity, for example when the liquid in the component compartment 2 has a higher viscosity than the liquid in the component compartment 3.

The pouring edges 11 and 12 are in the form of annular encircling edges. The inner pouring edge 11 has a height H1 which is slightly smaller than the height H2 of the outer pouring edge 12.

The distance A between the pouring edges 11, 12 substantially corresponds to the height H1 of the inner pouring edge. The outer edges 18 and 19 of the pouring holes 13 and 14 extend to the foot of the pouring edges 11 and 12.

Figure 2:
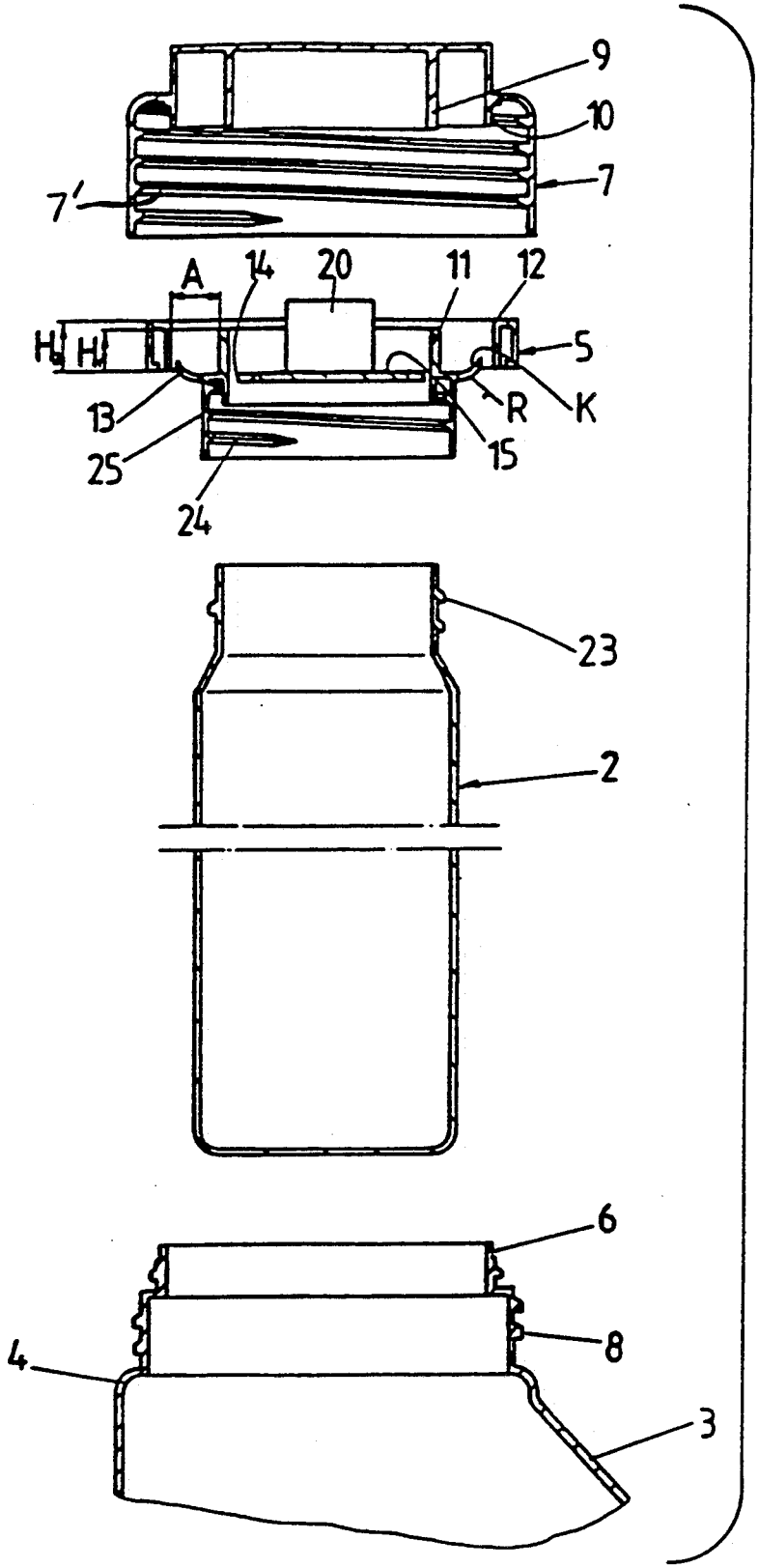
FIG. 2 is an exploded vertical cross-sectional view through the neck of the bottle, the inner component container, the pouring cap, and the closure cap.
Figure 3:
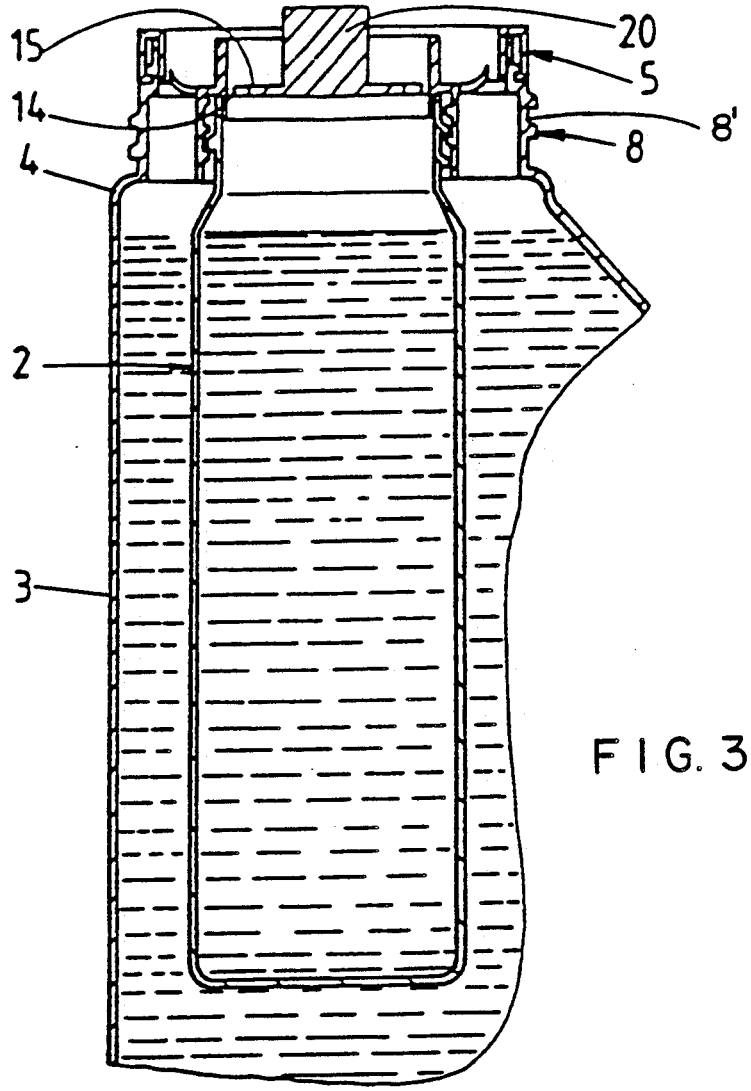
FIG. 3 is a partial vertical cross-sectional view through the neck of the bottle, or outer and inner containers, in the assembled state filled with various components.

In addition, the height H1 of the inner pouring edge 11 substantially corresponds to the opening (see FIGS. 2 and 4). As can be seen in particular from FIG. 4, the pouring openings 13 and 14 are substantially arcuate in shape. The outer pouring edge 12 merges with the outer surface 15 of the cap via a curve K, producing the upwardly curved edge R shown in FIG. 2. In the embodiment illustrated, the width B2 in the radial direction of the outer pouring opening 13 also corresponds substantially to the height of the inner pouring edge 11, which is a proven advantage from the pouring standpoint.

As shown in the drawings (see FIG. 4, for example), pouring openings 13,14 are provided twice, diametrically opposite, in the illustrated embodiment. This has the advantage that the pouring cap 5 can also be fitted offset through 180°. A guide tab 20 is formed on the common central axis AX of all the pouring openings 13,14 substantially in the middle of the pouring cap 5. By means of the guide tab 20, the pouring cap 5 can be gripped by an assembly robot and placed on the neck of the component compartment 2. There is no need for any preliminary sorting in regard to the alignment of the two pouring openings 13,14 in the pouring direction. Instead, the alignment of the pouring cap 5 can be confined to longitudinal orientation.

The mixing ratio between the two components is determined solely by the size ration between the pouring holes 13, 14 although the viscosities of the two components may also be an influencing factor. The pouring holes 13 and 14 are so small that they act as diaphragms.

Although various features of the invention have been shown and described hereon for purposed of illustration, modifications thereof may occur to those of ordinary skill in the art. Such modifications are meant to be covered by the spirit and scope of the appended claims.

What is claimed is:

1. A multicomponent product container comprising two separate component compartments covered by a common pouring cap, individual pouring openings for the first and second components, respectively, offset from one another relative to the longitudinal axis of said container, and opening in the plane of an outer surface provided in said cap, wherein said pouring openings are each juxtaposed in the pouring direction necessary for downward gravity flow of said first and second components to an individual pouring edge, respectively, which edges both rise beyond the outer surface of said cap, are wider than the associated pouring opening in the lateral or peripheral direction, and are shaped for providing in the tilted position of said container necessary for pouring via gravity said first and second components from said pouring openings a sink formed in the region of the associated pouring opening.

2. The multicomponent product container of claim 1, wherein said pouring edges provide inner and outer pouring edges, respectively, with the height of said inner pouring edge being slightly less than that of said outer pouring edge.

3. The multicomponent product container of claim 2, wherein the distance between said inner and outer pouring edges substantially corresponds to the height of the inner pouring edge.

4. The multicomponent product container of claim 2, wherein the outer edges of said pouring openings each extend approximately to the foot of their associated pouring edge.

5. The multicomponent product container of claim 2, wherein the height of the inner pouring edge substantially corresponds to the opening width in the radial direction of the innermost one of said pouring openings relative to the center of said cap.

6. The multicomponent product container of claim 2, wherein the outer and inner edges of the pouring openings are arcuate in shape.

7. The multicomponent product container of claim 1, wherein each of said pouring edges are in the form of encircling edges.

8. The multicomponent product container of claim 1, wherein said pouring edges are in the form of concentric circles.

9. The multicomponent product container of claim 1, further including the pouring openings being different in size, wherein another two pouring openings are formed opposite one another, and a guide tab is formed on the common central axis of all the pouring openings substantially in the middle of said cap.

* * * * *